US005346324A

United States Patent [19]

Kuo

[11] Patent Number: 5,346,324

[45] Date of Patent: Sep. 13, 1994

[54] DENTIFRICE DISPENSING TOOTHBRUSH WITH REPLACEABLE CARTRIDGE

[76] Inventor: Youti Kuo, 88 Foxbourne Rd., Penfield, N.Y. 14526

[21] Appl. No.: 127,828

[22] Filed: Sep. 28, 1993

Related U.S. Application Data

[63] Continuation-in-part of Ser. No. 762,470, Sep. 19, 1991.

[51] Int. Cl.[5] ..... A46B 11/02

[52] U.S. Cl. ..... 401/146; 401/141; 401/176; 401/269; 401/288

[58] Field of Search ..... 401/288, 146, 149, 150, 401/176, 141, 269, 134, 133; 222/207, 209

[56] References Cited

U.S. PATENT DOCUMENTS

| | | | |
|---|---|---|---|
| 1,563,190 | 11/1925 | House | 401/269 X |
| 1,658,940 | 2/1928 | Pollock | 401/134 |
| 3,080,590 | 3/1963 | Mullinix et al. | 401/146 X |
| 3,854,826 | 12/1974 | Adams | 401/141 X |
| 4,068,974 | 1/1978 | Meyer et al. | 401/150 |
| 4,116,570 | 9/1978 | Parenti | 401/155 |
| 4,221,492 | 9/1980 | Boscardin | 401/184 |
| 4,269,207 | 5/1981 | Konrad | 132/84 B |
| 4,301,948 | 11/1981 | Czech et al. | 401/176 X |
| 4,332,497 | 6/1982 | Rodriguez | 401/154 |
| 4,474,313 | 10/1984 | Sieverding | 401/150 |
| 4,521,128 | 6/1985 | O'Neal | 401/269 X |
| 4,564,130 | 1/1986 | Eulenberg | 272/207 |
| 4,651,904 | 3/1987 | Schuckmann | 222/207 X |
| 4,685,819 | 8/1987 | Endo | 401/176 |
| 4,787,765 | 11/1988 | Kuo | 401/191 |
| 4,892,231 | 1/1990 | Ball | 222/207 |
| 4,903,867 | 2/1990 | Mettenbrink | 401/150 X |

FOREIGN PATENT DOCUMENTS

| | | | |
|---|---|---|---|
| 536995 | 4/1955 | Belgium | 401/134 |
| 523340 | 4/1956 | Canada | 401/149 |
| 221362 | 5/1987 | European Pat. Off. | 401/150 |
| 2588734 | 4/1987 | France | 401/134 |
| 2598300 | 11/1987 | France | 401/150 |
| 539289 | 2/1956 | Italy | 401/134 |
| 2083142 | 3/1982 | United Kingdom | 401/176 |
| 2215593 | 9/1989 | United Kingdom | 401/150 |

*Primary Examiner*—Steven A. Bratlie
*Attorney, Agent, or Firm*—Fred L. Denson

[57] ABSTRACT

A dentifrice dispensing toothbrush is described which utilizes a compressible elastic button to pump a controlled quantity of dentifrice material from a replaceable cartridge to the brush head. The toothbrush locks itself to prevent further pumping of dentifrice material when its replaceable cartridge is nearly empty. The self locking mechanism eliminates the formation of voids in the dentifrice material and consequent pump failure when the spent cartridge is replaced. In one embodiment, a cover is provided which protects the brush head, bristles, pumping mechanism and other parts of the toothbrush. The cover also seals the conduit which supplies dentifrice material to the brush head to prevent it from becoming clogged with dried dentifrice material during periods of non use and to prevent accidental compression of the button. The compressible elastic button is part of a pump assembly which also includes a pump chamber, a partition which divides the pump chamber into an intake compartment and a discharge compartment, a one way check valve for an opening in the base of the pump chamber to control the flow of dentifrice material from the cartridge to the pump chamber and an opening in the partition between the intake and discharge compartments. A plug is attached to the top of a follower disc which is positioned in the cartridge. When the cartridge is nearly depleted, the plug locks the toothbrush by blocking the dispensing movement of the dentifrice material.

8 Claims, 10 Drawing Sheets

DENTIFRICE DISPENSING TOOTHBRUSH WITH REPLACEABLE CARTRIDGE

CROSS REFERENCE TO RELATED APPLICATIONS

This application is a continuation-in-part of copending application Ser. No. 07/762,470 filed Sep. 19, 1991 by Youti Kuo.

BACKGROUND OF THE INVENTION

1. Field of the Invention

The present invention relates to a toothbrush which pumps dentifrice material from a replaceable cartridge to the brush head. In particular, the invention provides means which increases the pumping efficiency and includes a cover having a slidable plug for sealing the opening in the brush head and pumping means during periods of non-use.

2. Description of the Prior Art

There are a variety of toothbrushes which store and dispense dentifrice material from the handle of the brush. One type of brush dispenses the dentifrice material at the base of the brush head where the bristles are attached, such as that described in U.S. Pat. No. 4,068,974. Another type dispenses dentifrice material directly onto the top of the brush surface as disclosed in U.S. Pat. No. 4,787,765. Most brushes store dentifrice material directly in a reservoir in the brush handle as typified by the brush shown in U.S. Pat. No. 4,269,207. Other brushes store the dentifrice material in a replaceable cartridge which is positioned in the reservoir. U.S. Pat. No. 4,116,570, as well as previously referenced U.S. Pat. Nos. 4,269,207, 4,068,974 and 4,787,765, describe brushes having this feature. Some of the cartridge toothbrushes contain a follower disc which advances in the cartridge as material is pumped therefrom and which serves as a seal to prevent backflow of material. This feature is described in U.S. Pat. Nos. 4,269,207 and 4,787,765. The prior art also includes toothbrushes that have detachable heads and which store dentifrice material in their handles. Exemplary patents in this regard include U.S. Pat. Nos. 4,269,207 and 4,332,497.

Various types of covers have been used with toothbrushes that store and dispense dentifrice material from the handle of the brush. A cover such as that shown in U.S. Pat. No. 4,521,128 protects the bristles and also plugs the opening which supplies dentifrice material to the brush head. The cover is secured to the brush head by inserting tabs on the cover into slots on the brush head. U.S. Pat. No. 4,332,497 discloses another type of cover which contains a stopper to seal the conduit which feeds dentifrice material to the brush head. The cover is placed over the brush head by inserting the brush handle through an opening in the cover and then closing a hinged portion of the cover over the brush head. The cover is not suitable for plugging a spout formed by a straight conduit which extends above the brush head base since the angular motion of the cover's stopper prevents its alignment with the spout opening. The type of cover shown in U.S. Pat. No. 4,221,492 encases the entire toothbrush, including the handle. This cover does not contain any component for protecting the opening which provides dentifrice material to the brush head.

The foregoing discussion illustrates some of the improvements which have been made in the design, structure, operation and protection of toothbrushes that store dentifrice material in their handles. However, the adhesive, paste-like consistency of the dentifrice materials used with the prior art bottom fed toothbrushes, has resulted in difficulties in consistently providing a smooth, void free flow of material. Also, the covers which have been used in conjunction with prior art bottom fed toothbrushes have shortcomings which effect the protection provided for the bristles and/or the efficiency for sealing the opening in the brush head platform particularly when the opening is extended by a spout. These difficulties and shortcomings associated with prior art bottom fed toothbrushes and their covers are more fully described below.

In any toothbrush which utilizes a replaceable cartridge for replenishing dentifrice material, continuous pumping after the cartridge is empty causes subsequent pumping problems and uneven material flow when the cartridge is replaced. A certain quantity of dentifrice material can still be pumped from the pump chamber, channels and other areas outside of the cartridge after it is empty. However, this causes the formation of voids in these places which results in inefficient pumping after the cartridge is replaced. For brushes that have piston-type pumping mechanisms, U.S. Pat. No. 5,062,728 utilizes a self-locking mechanism to prevent over-pumping when a cartridge reaches a near empty state. Such pumping mechanisms have sliding surfaces that are subject to leakage and contamination during brushing and cleaning. Also, the clogging of moving parts by dentifrice material impedes the spring-back function of the piston and leads to pumping failure. For this reason, piston-type pumping mechanisms which are used for dentifrice dispensing toothbrushes do not have broad consumer acceptability.

One way to avoid over-pumping involves the user's monitoring of the position of the follower disc through a viewing port in the handle. A viewing port as described in U.S. Pat. No. 4,787,765 allows the user to determine when the cartridge is nearly empty by observing the position of the follower disc. However, this approach does not ensure a failure-free operation of the toothbrush since the user may neglect to observe the position of the follower disc through the viewing port and may neglect to refrain from further pumping when the cartridge is empty.

The use of paste-like dentifrice materials in a bottom fed toothbrush has also resulted in difficulties which are caused by their tendency to dry out when exposed to air. This often causes the passageway which terminates in the brush head base to become clogged with dentifrice material that has dried out during periods of non use. The prior art has recognized and resolved this problem by providing a toothbrush cover with an attached plug that is inserted into the passageway opening thereby preventing the material therein from becoming dried out. However, the solution to this problem has created other problems. The covers of the prior art are cumbersome to place on the brush head to enclose all bristles without damaging some of the worn bristles that have become "fanned out" by wear. Worn bristles which have lost their stiffness and shape become angled and often are wedged out by the sidewall of the cover as it is positioned on the brush head. Also, while they effectively seal off the passageway which provides dentifrice material by restricting the flow of air thereto, some of the prior art covers have no means for ensuring adequate circulation of air to the brush head itself. Yet, the circulation of air through the bristles is essential for health reasons since they must be dried between uses prevent germ formation.

There is a need for a dentifrice dispensing toothbrush that does not utilize a piston type pumping mechanism but which efficiently overcomes problems that are caused by overpumping. More specifically, there is a need for a cartridge toothbrush which prevents further pumping when its cartridge is empty so that void formation in the dentifrice material is eliminated when a new cartridge is inserted. There is also a need for a bottom fed dentifrice dispensing toothbrush that has a cover that conveniently encloses all bristles, seals the conduit opening in the brush head base, permits air to freely circulate through the bristles to remove moisture and protects the pumping mechanism from accidental discharge of dentifrice material.

It is therefore an object of this invention to provide a bottom fed dentifrice dispensing toothbrush that does not use a piston type pumping mechanism and which has a replaceable cartridge which automatically hinders the pumping of the dentifrice material when the cartridge becomes empty.

It is a further object of the invention to provide a toothbrush which stores and pumps dentifrice material from its handle and which has a cover that conveniently and efficiently protects the bristles, pumping mechanism and seals the brush head opening.

SUMMARY OF THE INVENTION

In accordance with the present invention, a dentifrice dispensing toothbrush is provided which utilizes a compressible elastic button to efficiently pump a controlled quantity of dentifrice material in void free condition from a replaceable cartridge to the brush head. The invention also includes a cover for the dentifrice dispensing toothbrush which protects the brush head, bristles, pumping mechanism and other parts of the toothbrush. The cover not only protects the brush head and its bristles, but also seals the conduit which supplies dentifrice material to the brush head to prevent it from becoming clogged with dried dentifrice material during periods of non use. In addition, it prevents the accidental compression of the pumping button so that there is no unwanted discharge of dentifrice material when the toothbrush is placed in a pocket, purse or the like. Moreover, the cover permits for adequate circulation of air through wet bristles to ensure that they are dried in a manner which reduces the possibility of germ contamination.

The essential components of the toothbrush of the present invention include 1) a brush head having a platform with an outlet opening therethrough and to which a series of bristles are attached, 2) a handle which has a housing, 3) a removable cartridge including a follower disc positioned within the housing for storing dentifrice material, 4) a pump assembly which has a pump chamber, an elastic compressible button for supplying a pumping force, a partition which divides the pump chamber into an intake compartment and a discharge compartment, a one way check valve for an opening in the base of the pump chamber to control the flow of dentifrice material from the cartridge to the pump chamber and an opening in the partition between the intake and discharge compartments, 5) a neck containing a conduit for the flow of dentifrice material from the pump chamber to the brush head, 6) a plug attached to the top of the follower disc which internally blocks the dispensing movement of the dentifrice material and thereby locks the toothbrush by closing the opening in the base of the pump chamber and the opening in the partition between the intake and discharge compartments when the contents of the cartridge are depleted, and 7) a cover which includes a tubular housing which has an open end, a closed end, vent openings in the closed end and a slidable plug which includes a sealing rod which is insertable in the opening in the base of the brush head.

When the elastic button is depressed, a pumping force is applied which causes a quantity of dentifrice material to flow from a cavity in the elastic button and from the pump chamber through various conduits and to the brush head. During this time, back flow of dentifrice material from the pump chamber is prevented either by the follower disc or by a one-way check valve which is positioned at the base of the pump chamber. Upon release of the pumping force, the elastic button returns to its original shape due to its resilient nature. This spring-back action creates a vacuum force which causes dentifrice material to flow into the cavity of the compressible elastic button. Concurrently, because of the required continuity of flow of material, a quantity of dentifrice material moves from the reservoir in the cartridge in the handle into the pump chamber which in turn causes forward movement of the follower disc since it is under atmospheric pressure. The volume of dentifrice material that is dispensed is equivalent to the volume displaced by the advancement of the follower disc. The forward movement of the follower disc keeps the remaining dentifrice material in a packed, void-free condition which ensures good pumping efficiency during subsequent use.

The locking means for the toothbrush of this invention prevents overpumping when the useful contents of the removable cartridge are depleted. Prevention of overpumping eliminates the formation of voids in the dentifrice material. As discussed in more detail later, the follower disc is at its terminal position when the cartridge is empty. When in this position, the plug attached to the top of the follower disc is inserted in the opening in the base of the pump chamber and also in the opening in the partition. The size and shape of the plug are such that it simultaneously closes both openings. When this occurs, dentifrice material is locked in the intake compartment since it can neither flow into nor from this compartment when its openings are closed. Because the pumping force is supplied by the compressible elastic button that is attached to the intake compartment of the pump chamber, the button cannot be compressed to move the dentifrice material while the material is locked in the intake compartment. Thus, the entire pump assembly is rendered inoperable and over pumping cannot occur. When the spent cartridge is removed, the plug attached to the top of the follower disc is removed from the opening in the partition between compartments and from the opening in the base of the pump chamber. A new cartridge is inserted and neither opening becomes closed again until the contents of the new cartridge are depleted.

While the locking means improves efficiency by preventing void formation in the dentifrice material caused by overpumping, the reliability of the toothbrush operation is also increased by the cover of the invention. The cover plug is slidable in a straight path to seal the opening in the brush head platform. The opening may be extended by a spout which has a straight conduit portion for engaging the plug thereby eliminating clogging by dried out dentifrice material. Such clogging, if allowed to occur, blocks the flow of dentifrice material to the brush hand. The vent openings in the cover allow air to circulate among the bristles to ensure that they are properly dried. While the structure of the cover permits the bristles to be dried, it prevents the dentifrice material in the base opening from becoming dried during periods of non use. The cover also protects the bristles, the neck portion between the brush head and handle and the compressible elastic button which otherwise could be accidentally compressed during transport or other periods of non use. Even though the cover serves these multiple functions, it is easy to operate, yet is aesthetically attractive.

The invention and its objects and advantages will become more apparent by referring to the accompanying drawings and to the ensuing detailed description of the preferred embodiment.

DETAILED DESCRIPTION OF THE PREFERRED EMBODIMENTS

Figure 1:
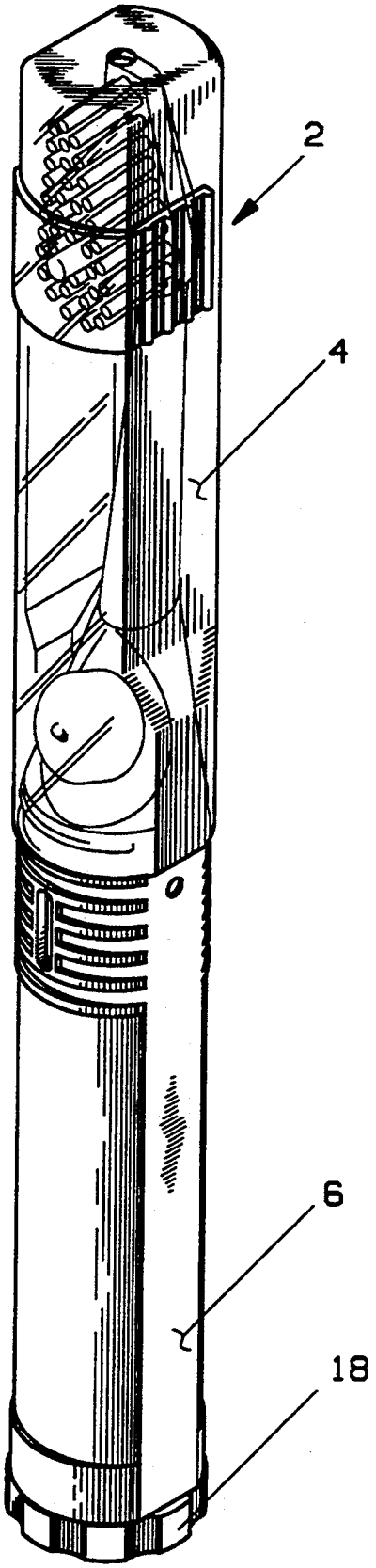
FIG. 1 is a perspective view of the dentifrice dispensing toothbrush of this invention with its cover attached.
Figure 2:
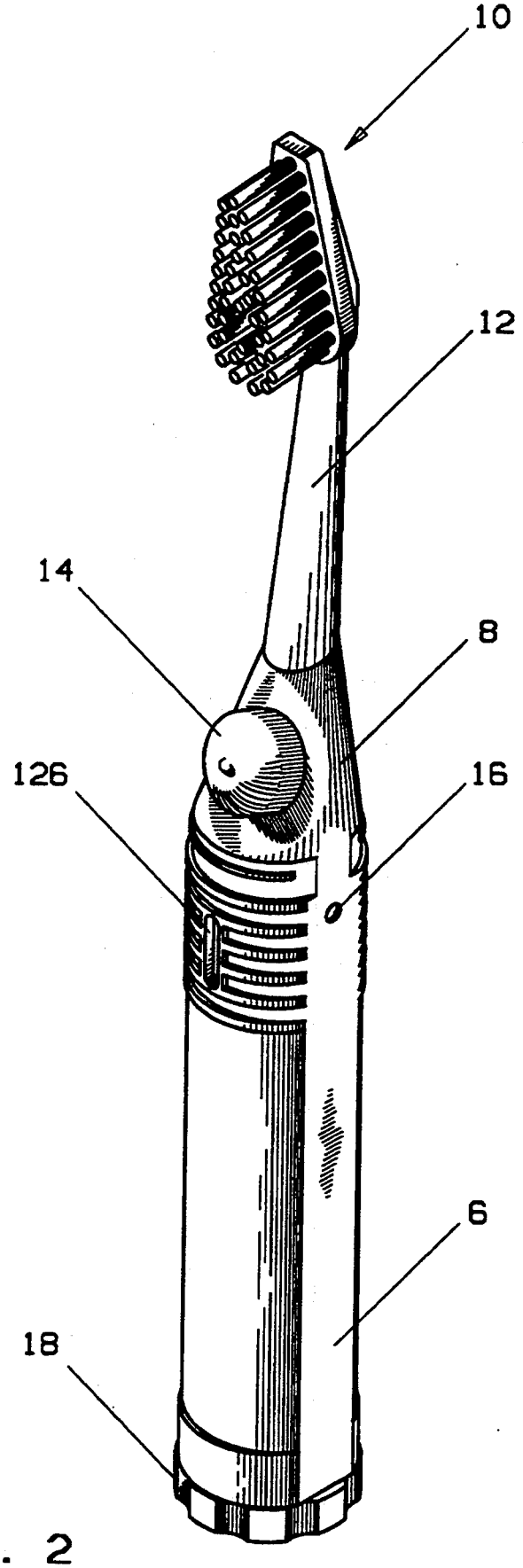
FIG. 2 is a perspective view of the dentifrice dispensing toothbrush of FIG. 1 without its cover.

As shown in FIGS. 1 and 2, the dentifrice dispensing toothbrush 2 of this invention includes brush head 10, neck 12, brush handle 6 and pump assembly 8. A cover 4 is provided to protect the toothbrush during periods when it is not being used. Dentifrice material is stored in a removable cartridge which is positioned in a reservoir inside of brush handle 6. The base 18 of the removable cartridge serves as the base for toothbrush 2 as well. Resilient elastic compressible button 14, which is positioned on pump assembly 8, is used to supply a pumping force which causes dentifrice material to flow from the reservoir to brush head 10. Ports 16 and 126 serve as vents for trapped air when a cartridge is inserted. Port 126 is also a visual gauge for determining when the cartridge is in a near empty state. FIG. 2 shows toothbrush 2 with cover 4 removed.

Figure 3C:
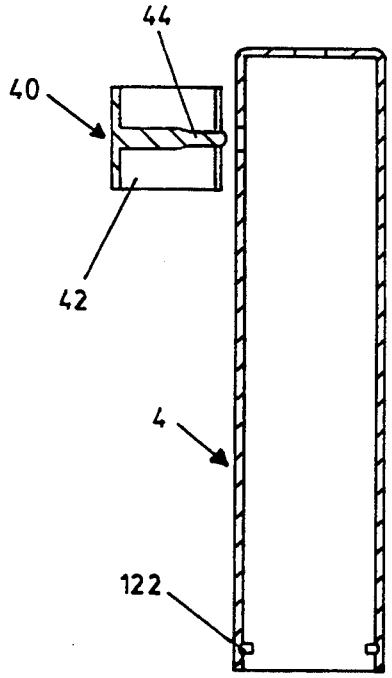
FIGS. 3A, 3B and 3C are a plan view of the unassembled basic components for the toothbrush used in one embodiment of this invention.
Figure 3A:
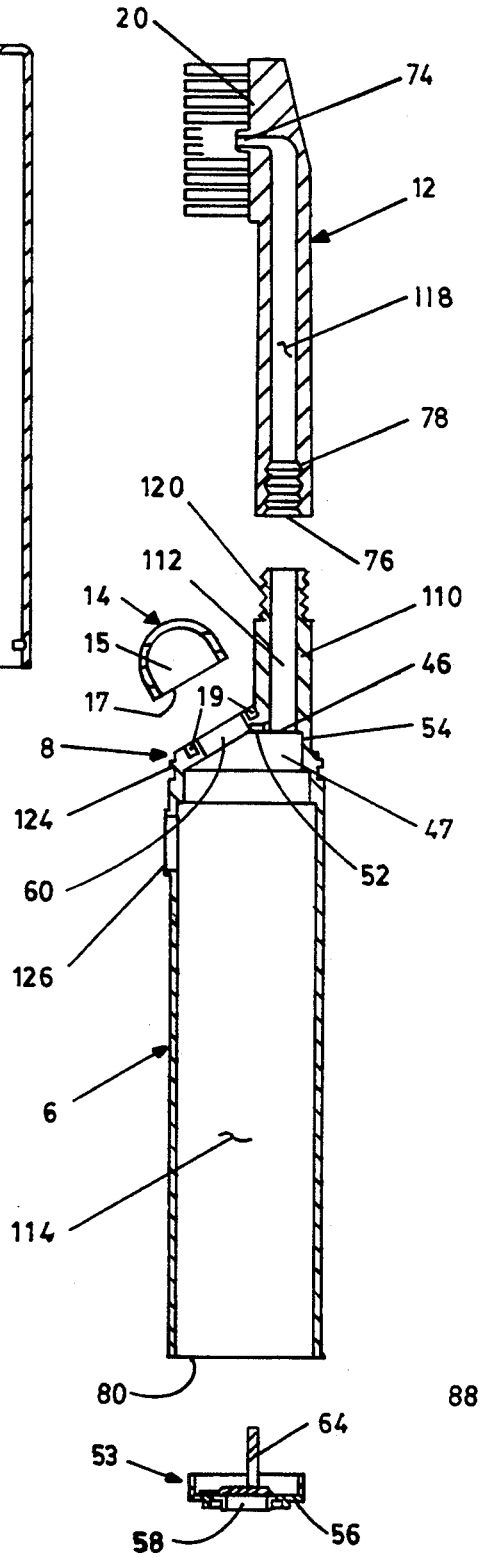
Figure 3B:
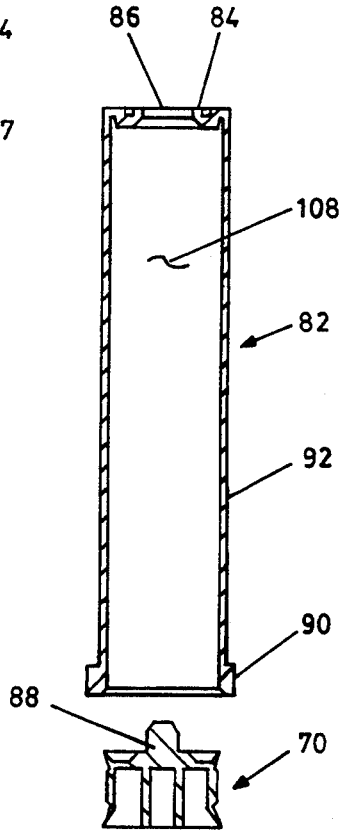

FIGS. 3A, 3B and 3C show the basic unassembled components used in one embodiment of the invention. In this embodiment, brush handle 6 contains a cavity 114 for cartridge 82 which has a reservoir 108 for storing dentifrice material. Pump assembly 8 includes pump chamber 47 and resilient elastic compressible button 14 for supplying a pumping force. Chamber 47 has base 56, top 52 and sidewall 54. Base 56, which is a part of valve assembly 53, has one opening 58 and top 52 has two openings, 46 and 60. Compressible elastic button 14, which includes bell shaped cavity 15 and bottom rim 17, is mounted on opening 60. Bottom rim 17 of button 14 is inserted into groove 19 on the periphery of opening 60 in top 52 in a manner such that compressible elastic button 14 remains firmly in place and prevents dentifrice material from leaking around the periphery of the bottom rim of the button when a pumping force is applied. Chamber extension 110 having hollow conduit 112 is attached to top 52 so that hollow conduit 112 is aligned with opening 46.

Figure 6B:
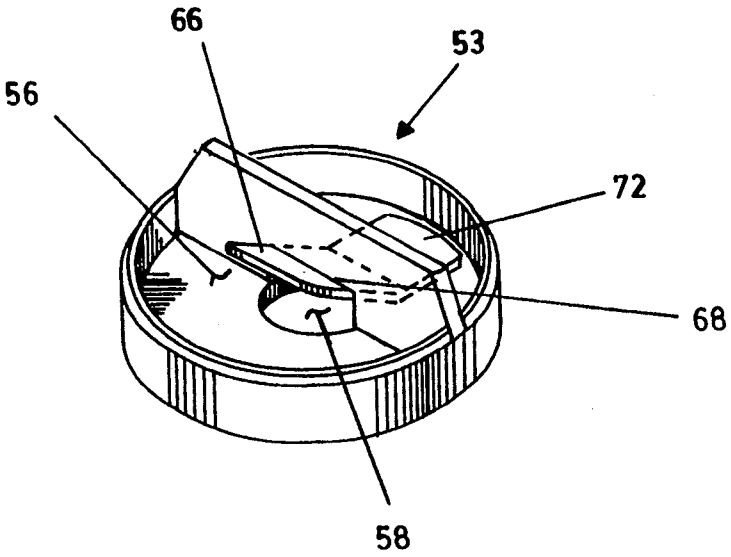
FIG. 6B is a perspective view of the valve assembly shown in FIG. 6A with the one way flap check valve in an open position.
Figure 6A:
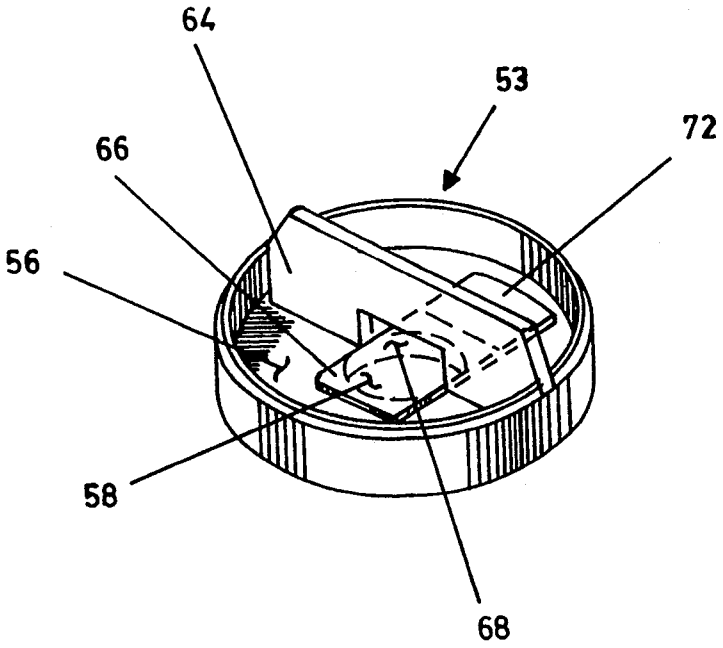
FIG. 6A is a perspective view of a valve assembly which shows a one way flap check valve in a closed position as used in the toothbrush shown in FIG. 3A.

A check valve assembly 53 is positioned at the base of pump chamber 47 as shown in FIG. 3A. FIGS. 6A and 6B respectively show the components of the check valve assembly in the closed and opened position. The assembly consists of flexible flap valve 66 which overlies opening 58 in pump chamber base 56. Flexible flap valve 66 is movably attached to hinge 72 which is fastened to base 56. When a pumping force is applied by depressing button 14, the valve assembly is forced to the closed position of FIG. 6A with flexible flap valve 66 covering opening 58 to prevent backflow of dentifrice material from pump chamber 47. When the pumping force is released, flexible flap valve 66 is in the open position of FIG. 6B which allows dentifrice material to flow into pump chamber 47.

Figure 4A:
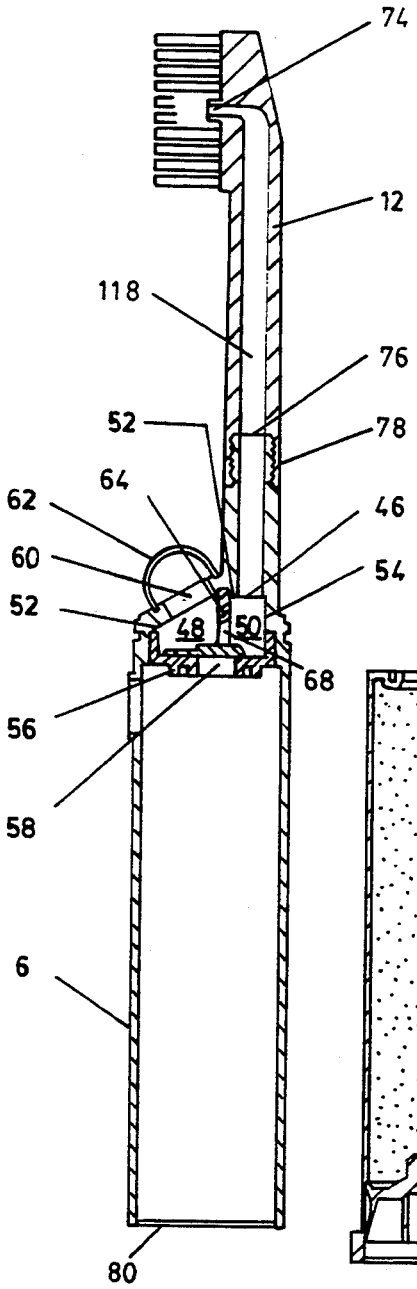
FIG. 4A is an orthographic view of an embodiment of the toothbrush of the invention without a cartridge inserted in the handle.

Pump chamber 47 contains partition 64 which extends vertically from chamber base 56 to chamber top 52 and which divides pump chamber 47 into intake compartment 48 and discharge compartment 50 as shown in FIG. 4A. The top of partition 64 is positioned between openings 46 and 60 in top 52 of chamber 47 and the bottom of partition 64 is attached to chamber base 56 in a manner such that it overlies opening 58 therein. The sides of partition 64 adjoin pump chamber side wall 54. FIG. 6A shows partition 64 as part of check valve assembly 53. Arched aperture 68 is positioned in partition 64 in a manner such that it overlies flap check valve 66 and opening 58. The width of aperture 68 is substantially the same as the width of flap check valve 66 but does not restrict its motion. The height of aperture 68 is less than the length of the portion of flap check valve 66 that extends beyond partition 64 away from hinge 72 so as to restrict the vertical movement of check valve 66 when in an open position. While partition 64 separates intake compartment 48 and discharge compartment 50, communication between the compartments is maintained through arched aperture 68.

Figure 5:
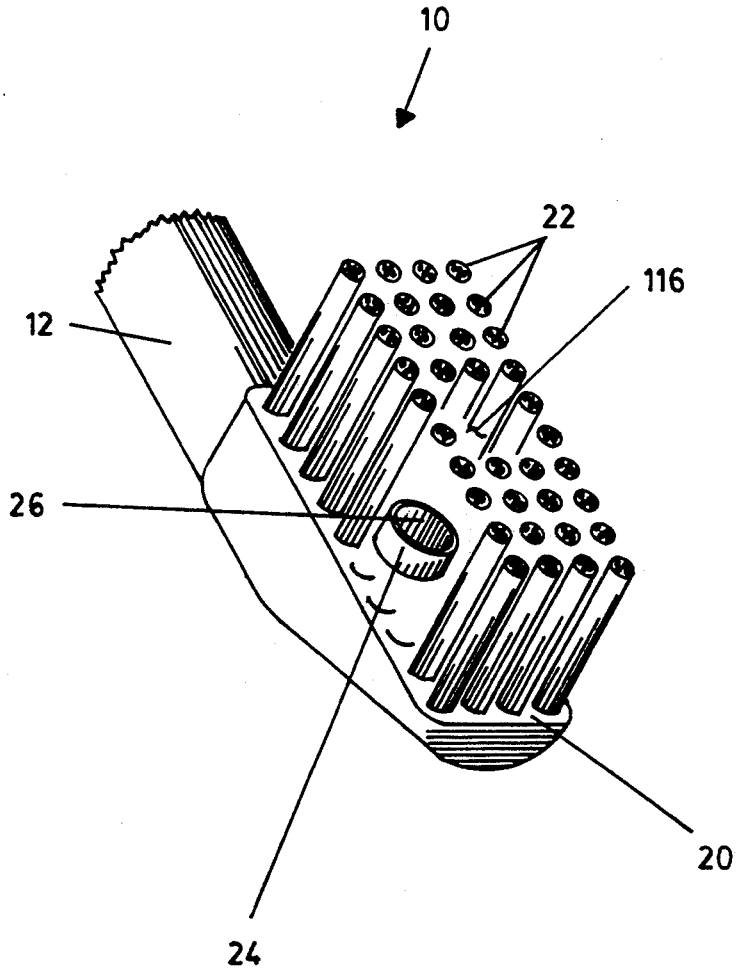
FIG. 5 is a perspective view of the brush head used with the toothbrush of this invention.

As shown in FIG. 5, brush head 10 includes platform 20 which is connected to neck 12. Platform 20 has a series of bristles 22 attached thereto. It also contains spout 24 and spout opening 26. Bristles 22 are configured so as to form opening 116 as a continuation of opening 26 as shown in FIG. 5. Neck 12 is comprised of hollow conduit 118 having two open ends as shown in FIG. 3A. Open end 76 is in communication with the end of hollow conduit 112 of chamber extension 110. The remaining end of conduit 118 terminates at opening 74 in platform 20. Neck 12 and chamber extension 110 are connected by joining threads 120 on extension 110 with threads 78 on neck 12. This facilitates removal and replacement of the brush head when necessary or desirable.

Figure 4B:
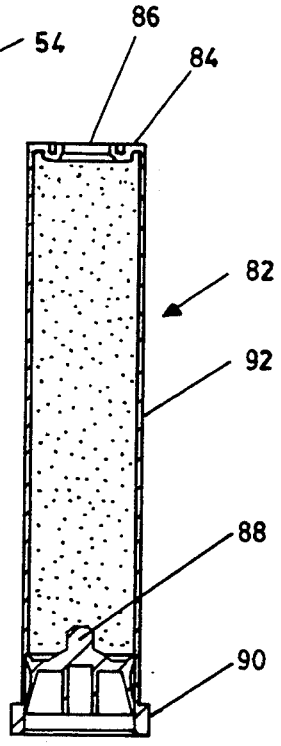
FIG. 4B is an orthographic view of a cartridge which is insertable in the handle of the toothbrush depicted in FIG. 4A.
Figure 4C:
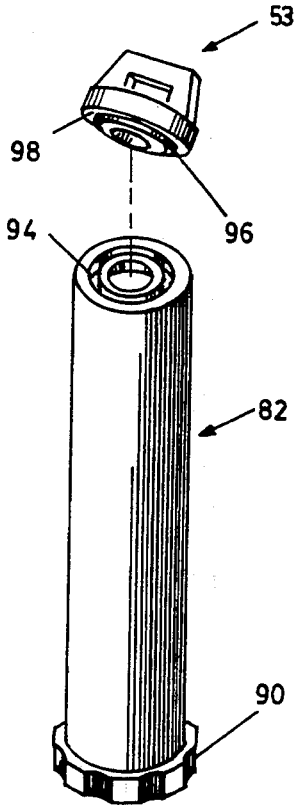
FIG. 4C is a perspective view of the cartridge and valve assembly that are used in the toothbrush of this invention.
Figure 7:
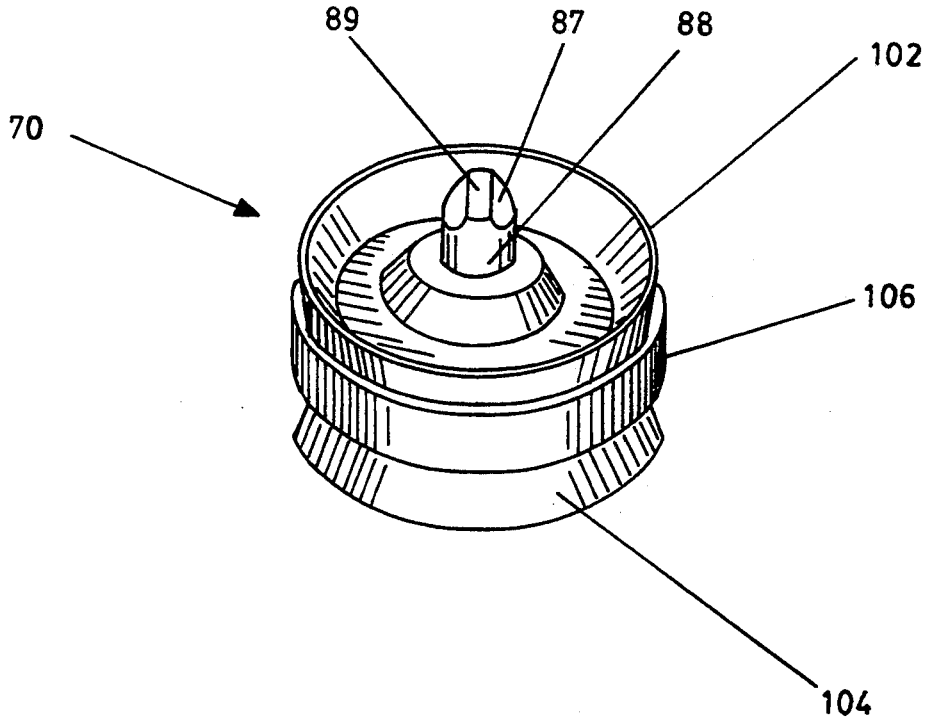
FIG. 7 is a perspective view of a follower disc as used in the cartridge of FIG. 3B for the toothbrush of this invention.

Cartridge 82 includes sidewall 92, top 84, top opening 86, base 90, reservoir 108 and follower disc 70 as shown by FIGS. 3B, 4B and 4C. Annular groove 94 is positioned around opening 86 and is mateable with a corresponding rim 96 on the exterior surface 98 of the base of check valve assembly 53 for sealing purposes when the cartridge is placed in the handle reservoir. Reservoir 108 of cartridge 82 contains dentifrice material which is pumped therefrom to brush head 10 by passing through top opening 86, opening 58 in base 56, pump chamber 47, opening 46, conduit 118, spout opening 26 and bristle opening 116 to the surface of bristles 22 on to brush head 10. Follower disc 70 is inserted at cartridge base 90 of reservoir 108 to prevent leakage of dentifrice material when a pumping force is applied to compressible elastic button 14. It advances in reservoir 108 as dentifrice material is pumped therefrom until it reaches its terminal position by contacting top 84. The one-way movement of follower disc 70 is accomplished by flap check valve 66 functioning to block backflow of dentifrice material from pump chamber 47. Because follower disc 70 is insulated from the effects of the pumping force applied to compressible elastic button 14, it efficiently contacts the reservoir sidewall and provides a seal for preventing leakage of dentifrice material. Follower disc 70 has upper annular rim 102 and lower annular rim 104 positioned at the ends of cylinder 106 as shown in FIG. 7. Each annular rim has a shade which is conformable to the inner wall of cartridge 82. Both rims are flexible and have outer dimensions that are slightly larger than that of the inner wall of cartridge 82. This arrangement ensures a snug fit of the rims with the inner wall of cartridge 82 to enhance the sealing capability of follower disc 70.

When the contents of cartridge 82 are depleted, it is removed and a new cartridge is positioned in reservoir 114 by inserting it through bottom 80 of brush handle 6. When fully inserted, opening 86 of cartridge 82 is aligned with and in communication with opening 58 in the base of the pump chamber and cartridge top 84 is flush against exterior surface 98 of base 56 of valve assembly 53. In order to protect against leakage of dentifrice material at the connecting point, a seal is formed when annular rim 96 on exterior surface 98 of the chamber base is mated with annular groove 94 on top surface 84 of cartridge 82 after the cartridge is fully inserted. For venting entrapped air during insertion of cartridge 82, handle 6 is provided with port 126 and port 16 which is located in close proximity to pump chamber base 56. During removal of cartridge 82, air enters port 16 to break the vacuum force and facilitate the removal process.

The location of port 16 in close proximity to the flap check valve requires that an air tight seal be maintained in the interface area between the cartridge top and the check valve. While an air tight connection can be achieved by using standard threaded connectors, a deep well opening in the cartridge top or pump assembly base would be required to accommodate the threads of the connectors. However, the well would trap sufficient air when the cartridge is inserted to impede the pumping efficiency. Annular rim 96 together with matching annular groove 94 as used in this invention reduce air trapping and provide an air tight seal. The close contact between the wall of the groove and the wall of the rim increases the sealing surface area between the cartridge top and the valve seat such that little or no seepage of air occurs between the vent opening and the cartridge opening. The sealing efficiency is enhanced when multiple annular grooves and matching rims are used. One advantage of this type of sealing is that the confined air space is minimal (equivalent to the volume of the opening in the cartridge top) as compared to the confined air space when threaded connectors are used (equivalent to the volume of the space where the threads are located). Another advantage is that it enables the engagement of a cartridge having a non-circular cross section such as an oval shape, which is the preferred shape of the handle from an ergonomic standpoint. A thread type sealing connector cannot be used for a cartridge cylinder of non-circular cross section as it requires rotational motion for engagement and disengagement.

Figures 8A, 8B, 8C, 8D:
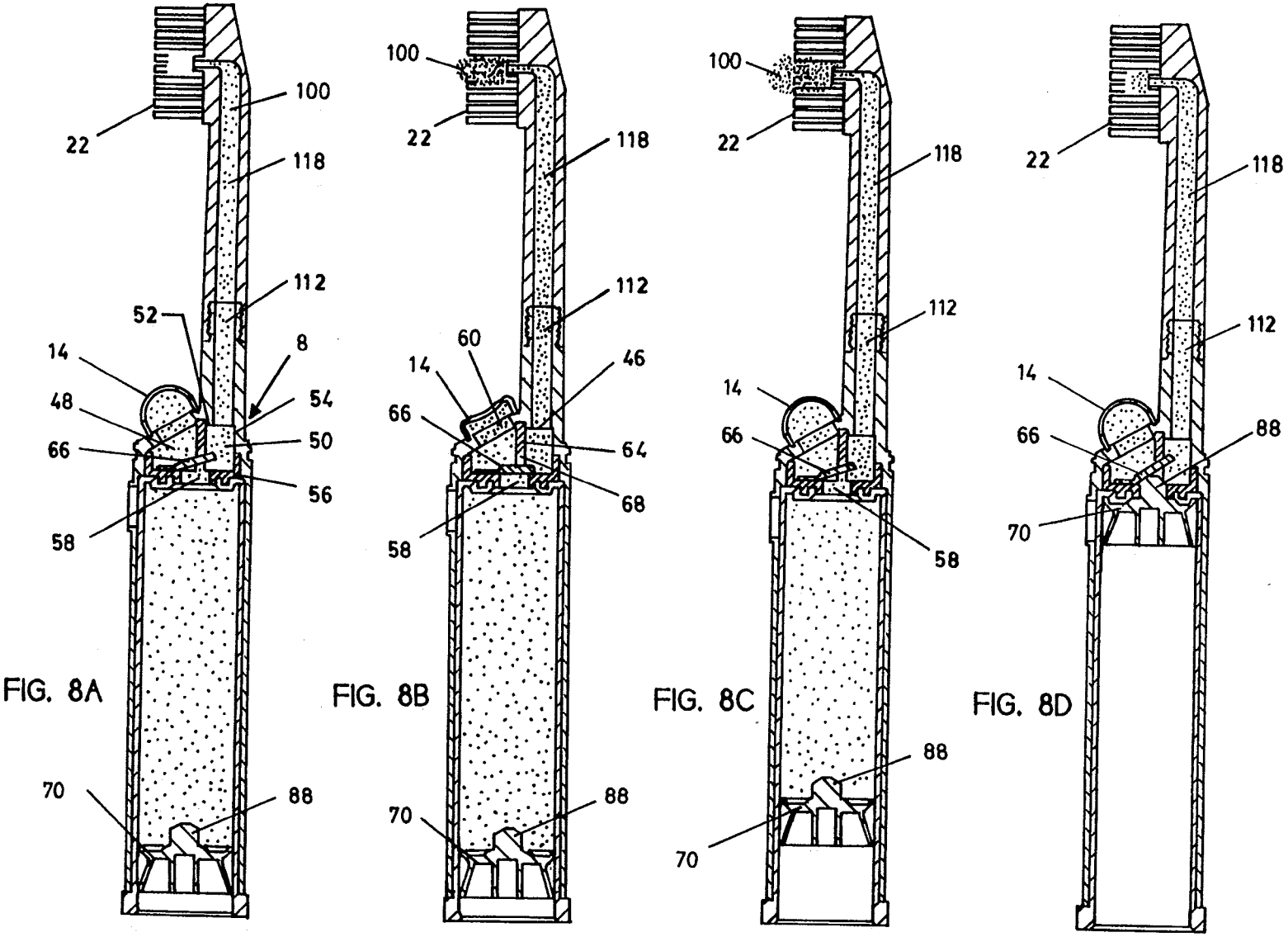
FIGS. 8A through 8D are orthographic views of one embodiment of the toothbrush of this invention showing the relative positioning of parts for each step of an operating cycle.

FIGS. 8A through 8C show the sequential positions of the components for one operating cycle of the toothbrush. In the first stage, FIG. 8A, compressible elastic button 14 is in a non-pumping position and is maintained in its fully extended position due to its elastic nature. Flap check valve 66 is in its open position as a result of filling the toothbrush with the dentifrice material. In the second stage, FIG. 8B, compressible elastic button 14 is pushed down to cause dentifrice material to flow from intake compartment 48 and discharge compartment 50 of pump chamber 47 through conduits 112 and 118 to bristles 22. The other components are maintained in the same positions that they had in the first stage. The pumping force applied to compressible elastic button 14 causes flap check valve to move to its closed position sealing off opening 58. As compressible elastic button 14 is being compressed, the backward movement of the dentifrice material toward cartridge base 90 is blocked by one-way flap check valve 66. The quantity of the dentifrice material dispensed to the brush head is the same as the displacement volume of cavity 15 of compressible elastic button 14 during one pumping sequence.

In the third stage, as shown in FIG. 8C, the components and dentifrice material are in their ready for use positions. Compressible elastic button 14 is in its initial, at rest position and a controlled quantity of dentifrice material 100 is positioned on bristles 22 of brush head 10. No additional material is pumped to brush head 10 during brushing action. When the compressing force which had been applied to compressible elastic button 14 is released, button 14 returns from its compressed position to its original shape because of the resiliency and memory of the material from which it is made. At the same time, the dentifrice material in button cavity 15, intake compartment 48 and cartridge reservoir 108 moves with compressible elastic button 14 and follower disc 70 advances to a new forward position that keeps the dentifrice material in a packed condition. In all of these movements and during the elastic recovery of button 14, the dentifrice material is under a stretching condition between the pulling force of compressible elastic button 14 and the resistant force of follower disc 70. Void formation in the dentifrice material caused by such stretching is reduced or eliminated by the pressure difference between the ambient atmospheric pressure and the vacuum pressure, if any, within the voids.

Additional quantities of dentifrice material are dispensed through repeated pumping actions. When reservoir 108 reached a near empty state as shown in FIG. 8D, residual dentifrice material can still be pumped therefrom by depressing button 14. The user is made aware when the contents of reservoir 108 are nearing depletion by viewing the position of follower disc 70 through port 126 when it is at or near cartridge top 84.

When cartridge 108 reaches a near empty state as shown in FIG. 8D, follower disc 70 is in its terminal position. In this position cartridge plug 88 is fully inserted in pump chamber base opening 58 so as to prevent the flow of any dentifrice material therethrough. Plug 88 is also inserted in partition aperture 68 so that end 89 contacts the under side of flap valve 66 and forces it against the upper part of aperture 68 thereby blocking the flow of any dentifrice material from intake compartment 48 to discharge compartment 50. Moreover, because plug 88 closes base opening 58, dentifrice material cannot flow from intake compartment 48 through this opening. Thus, when the contents of cartridge 82 are fully expended, intake compartment 48 is filled with dentifrice material that is retained therein since both openings to this compartment are closed. Because the dentifrice material is not compressible, elastic button 62 cannot be depressed to dispense the dentifrice material. As a result of this sequence, the toothbrush automatically locks elastic button 14 when the useful contents of cartridge 82 are depleted so that no additional pumping can occur.

The spent cartridge is removed by extracting it from the base 80 of reservoir 114. A new cartridge filled with dentifrice material is inserted into the reservoir. As it is moved forward into the reservoir, trapped air is vented through ports 126 and 16. After the new cartridge is fully positioned and its useful contents are depleted, port 126 serves as a gauge for viewing when the follower disc reaches its terminal position.

If follower disc plug 88 is not used, button 14 can continue to be depressed after the cartridge is empty and the residual dentifrice material in chamber 47 will continue to be pumped therefrom. When the spent cartridge is replaced with a new one filled with dentifrice material, chamber 47, conduits 112 and 118 will have a significant volume of voids which result from the previous over pumping. This adversely effects subsequent pumping efficiency in that when a subsequent pumping force is applied, irregular quantities of dentifrice material are dispensed and the flow is not smooth and continuous. Furthermore, when the pumping force is released, the voids have a tendency to become larger because the follower disc advances less than it should due to an inadequate vacuum force. Eventually, there is an inability to pump any dentifrice material due to a complete breakdown of the vacuum force.

As previously explained, ports 16 and 126 are used to vent air during the replacement of the cartridge. Their locations are based on ergonomic considerations. Besides venting air, port 126 is also used to view the empty status of the cartridge. The cartridge is preferably transparent so that the location of a colored follower can be readily discerned. As viewed through port 126 which is preferably in the shape of a slot, the cartridge is nearly empty when the follower is near the end of the slot. In order to provide for a signal which indicates that the cartridge is nearly empty, one end of the slot is positioned at a specified distance from the interface between the valve seat and the cartridge top. This distance allows for more than one full advancement of the follower in response to the full release of the button following one full stroke of pumping. This provides a built in safety factor to ensure that the spent cartridge is replaced in a timely manner. When no more dentifrice is seen through the slot, the user discontinues pumping and replaces the cartridge. Even if the user ignores the empty state of the cartridge and continues to pump, the self-locking mechanism previously described hinders the compression or the flexible button. Without overpumping, no voids are created inside of the pump chamber. Port 126 does not vent air beyond the end of the slot. However, port 16 is placed between port 126 and the interface between the valve seat and cartridge top. The two ports are preferably positioned 90 degrees apart in case one is inadvertently covered during use.

Figure 9A:
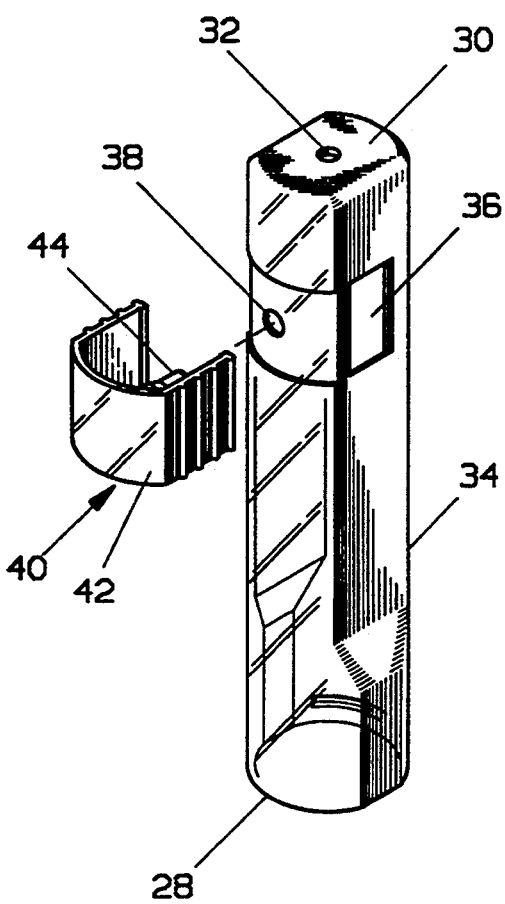
FIGS. 9A, 9B and 9C are perspective views of a cover for the toothbrush of this invention showing sequential stages of closure for its plug component.
Figure 9B:
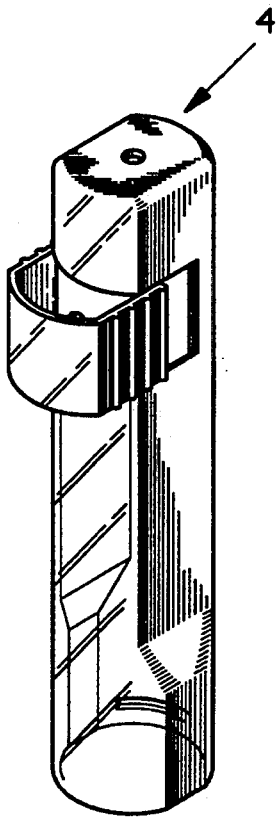
Figure 9C:
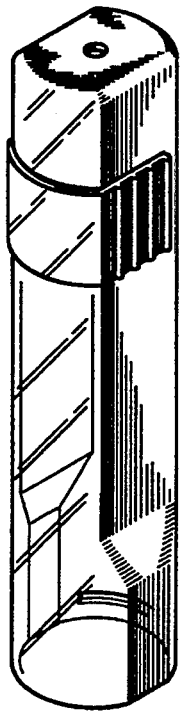
Figure 10A:
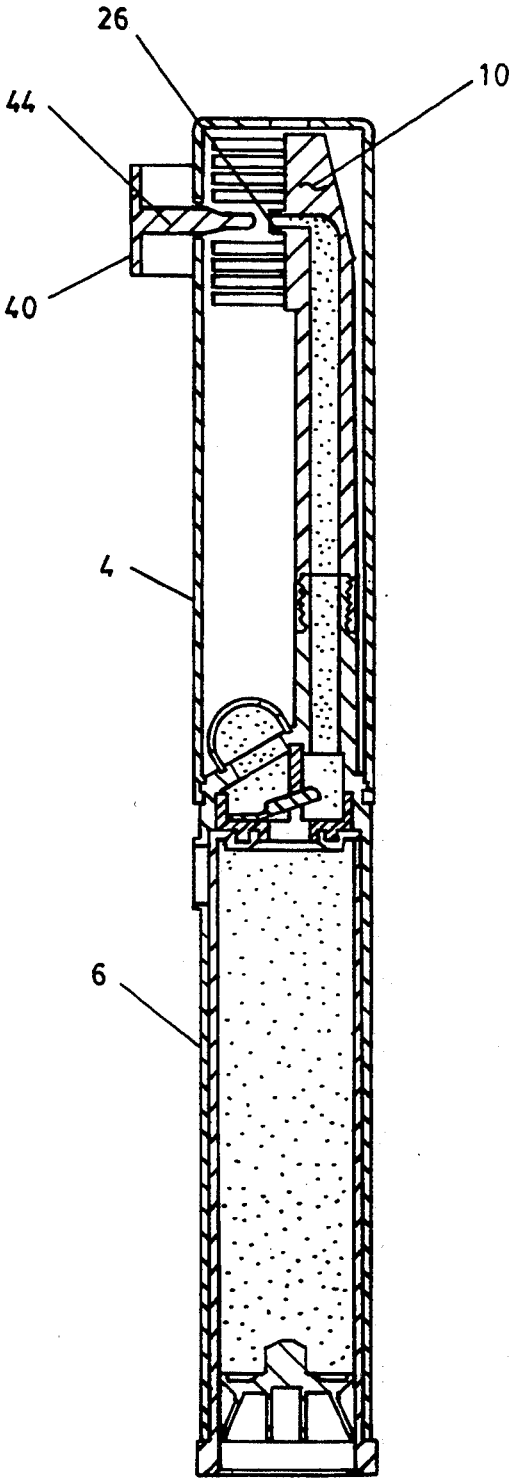
FIGS. 10A and 10B are orthographic views of the toothbrush of this invention with cover attached showing the placement relationship of the plug to the cover and the brush head before and after the plug is at the sealing position.
Figure 10B:
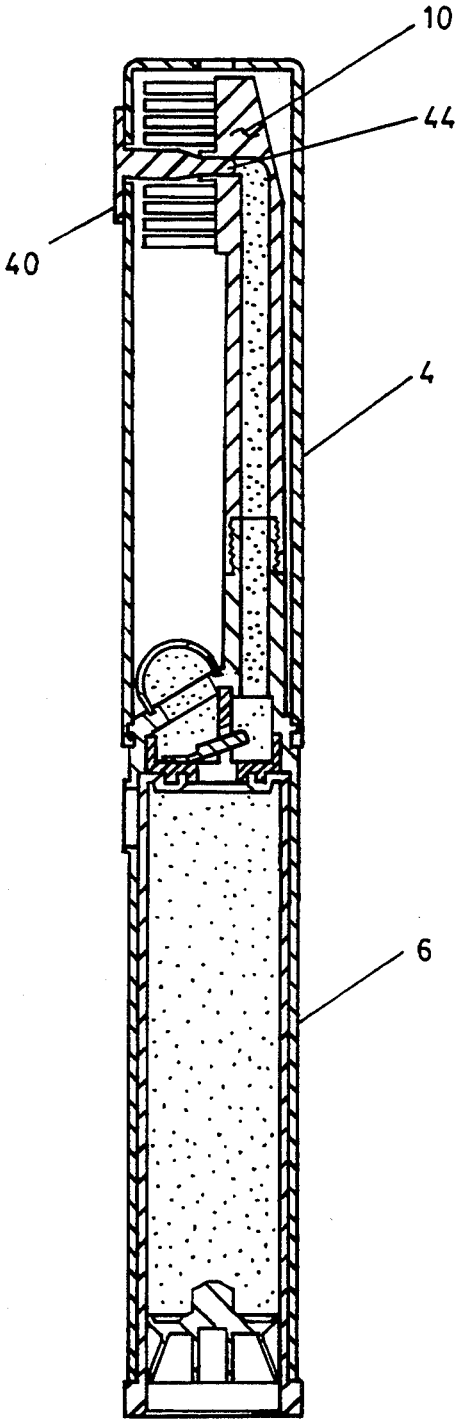

During periods of non use, cover 4 protects bristles 22 and neck 12 from damage. Because it is attachable to the brush handle, it also protects elastic button 14 from being accidentally compressed during transport or storage. The features of cover 4 eliminate clogging of the dentifrice material in spout opening 26. As shown in FIGS. 9A, 9B and 9C, cover 4 is a tubular housing having an open end 28, a closed end 30 and a side wall 34. Part of side wall 34 is recessed so as to form guide area 36. Opening 38 is positioned in guide area 36 so that it is in line with spout opening 26 of brush head 10 when cover 4 is in place in its closed position. Cover plug 40 includes slidable saddle flange 42 and sealing rod 44. Saddle flange 42 is slidably mounted in guide area 36. Sealing rod 44 is positioned on the underside of saddle flange 42 in a manner that permits its insertion through opening 38 and its alignment with spout opening 26.

As shown in FIGS. 3A, 3C, 10A and 10B, cover 4 is attached to handle 6 by engaging grooves 122 in the inner surface of the cover side wall with corresponding ribs 124 on handle 4. After cover 4 is in position, plug 40 is mounted onto guide area 36 and is slid into its final position with sealing rod 44 inserted into spout opening 26. The diameter of sealing rod 44 is such that it can be inserted into spout opening 26 and seal the opening so that dentifrice material in conduit 118 does not dry out and clog the opening. When the cover is fully positioned, bristle drying is enhanced by vent 32 in closed end 30 of the cover.

The features of the cover are user friendly. The prealigned position of plug 40 and sealing rod 44 in relation to spout opening 26 ensures that the user will readily be able to seal the spout opening merely by pressing the plug downward after the cover is closed. The cover is locked when the sealing rod is in the spout opening. Removal of the cover and plug is accomplished simply by pulling the plug upward to disengage the sealing rod from the spout opening and then moving the assembly in the axial direction. The removal process can be completed even when the sealing rod Is not fully out of the bristles since they are flexible and yield to the movement of the more rigid sealing rod.

The invention has been described in detail with reference to a preferred embodiment thereof. However, it will be understood that variations and modifications can be effected within the spirit and scope of the invention.

I claim:

1. A dentifrice dispensing toothbrush comprising:

a. a pump assembly which consists of:

i. a pump chamber having a base which has an interior surface and an exterior surface, a top, a side wall disposed between the interior surface of the base and the top, a first opening positioned in the base, a second opening positioned in either the sidewall or the top and a third opening positioned in the top;

ii. a resilient, elastic, compressible button for supplying a pumping force, said button having an external surface, an internal surface and a base which is fixed to the second opening in the top or side wall of the pump chamber in a manner such that the button is depressed when a pumping force is applied to its external surface forcing dentifrice material to flow from the pump chamber through the third opening in the top thereof, and is returned to its original shape by its resilient force when the pumping force is released causing dentifrice material to flow to the pump chamber through the first opening in the base of the chamber;

iii. a partition which divides the pump chamber into an intake compartment and a discharge compartment, said partition being attached to the top of the pump chamber between the second and third openings and to the interior surface of the base of the pump chamber in a manner such that it overlies the first opening;

iv. a flap check valve attached to the interior surface of the base for preventing backflow of dentifrice material through the first opening in the base of the pump chamber;

v. an arched aperture in said partition for placing the intake compartment and discharge compartment in communication with each other, said arched aperture being positioned in the end of the partition that is attached to the interior surface of the base in a manner such that it overlies the flap check valve and the first opening, the width of said arched aperture being substantially the same as the width of the flap check valve and the height of said arched aperture being less than the length of the flap check valve;

b. a brush head having a platform with an outlet opening therethrough and a series of bristles which are attached to the platform;

c. a neck comprising a hollow conduit having two open ends, one of which is in communication with the opening in the platform of the brush head and the remaining of which is in communication with the third opening in the top of the pump chamber; and d. a brush handle comprising a housing for storing a removable cartridge, said housing being comprised of a tubular side wall having a top which is attached to the exterior surface of the base of the pump chamber and a bottom which is open;

e. a removable cartridge stored in said housing, said removable cartridge being comprised of:

i. a top which has an interior surface and an exterior surface, said top having an opening therethrough which is in communication with the opening in the base of the pump chamber;

ii. a base;

iii. a side wall disposed between the base and the top;

iv. a follower disc; and f. locking means for preventing pumping action when the follower disc is at its terminal position, said locking means comprising a plug which is attached to the follower disc and which simultaneously blocks the flap check valve in its open position while sealing off the first opening and the arched aperture when the follower disc is at its terminal position, thereby preventing further flow of dentifrice material from the cartridge and the intake chamber to the discharge chamber and the brush head.

2. The dentifrice dispensing toothbrush described in claim 1 wherein an annular rim is positioned on the exterior surface of the base of the pump chamber in close proximity to the periphery of the opening in the base, and an annular groove is positioned on the exterior surface of the top of the removable cartridge in close proximity to the opening in the top, said groove being mateable with the rim on the exterior surface of the base of the pump chamber when the removable cartridge is stored in the housing.

3. The dentifrice dispensing toothbrush described in claim 1 wherein the brush handle housing has a vent opening positioned through its tubular side wall.

4. The dentifrice dispensing toothbrush described in claim 1 wherein the brush head is detachable and replaceable.

5. The dentifrice dispensing toothbrush described in claim 1 wherein the brush head includes a spout which is attached to the outlet opening in the platform.

6. The dentifrice dispensing toothbrush described in claim 1 including a cover for the brush head, neck and pump assembly comprising:

a tubular housing having:

i. an open end which is attached to the brush handle;

ii. a closed end with one or more vent openings therethrough;

iii. a side wall disposed between the open end and the closed end, said side wall having a guide area on a portion of its surface and an opening through the side wall positioned in the guide area in line with the outlet opening of the brush head platform when the cover is in the closed position; and b. a plug comprised of a slidable saddle flange having a sealing rod attached to its inner surface, said saddle flange being slidably mounted in the guide area of the side wall surface in a manner such that the sealing rod is engaged through the opening in the side wall and is aligned and mateable with the opening in the platform of the brush head.

7. A dentifrice dispensing toothbrush comprising:

a. a pump assembly which consists of:

i. a pump chamber having a base which has an interior surface and an exterior surface, a top, a side wall disposed between the interior surface of the base and the top, a first opening positioned in the base, a second opening positioned in either the sidewall or the top and a third opening positioned in the top;

ii. a resilient, elastic, compressible button for supplying a pumping force, said button having an external surface, an internal surface and a base which is fixed to the second opening in the top or side wall of the pump chamber in a manner such that the button is depressed when a pumping force is applied to its external surface forcing dentifrice material to flow from the pump chamber through the third opening in the top thereof, and is returned to its original shape by its resilient force when the pumping force is released causing dentifrice material to flow to the pump chamber through the first opening in the base of the chamber;

iii. a flap check valve attached to the interior surface of the base for preventing backflow of dentifrice material through the first opening in the base of the pump chamber;

b. a brush head having a platform with an outlet opening therethrough and a series of bristles which are attached to the platform;

c. a neck comprising a hollow conduit having two open ends, one of which is in communication with the opening in the platform of the brush head and the remaining of which is in communication with the third opening in the top of the pump chamber;

d. a brush handle comprising a housing for storing a removable cartridge, said housing being comprised of a tubular side wall having a top which is attached to the exterior surface of the base of the pump chamber and a bottom which is open;

e. a removable cartridge stored in said housing, said removable cartridge being comprised of:

i. a top which has an interior surface and an exterior surface, said top having an opening therethrough which is in communication with the opening in the base of the pump chamber;

ii. a base;

iii. a side wall disposed between the base and the top;

iv. a follower disc; and f. a cover for the brush head, neck and pump assembly comprising:

i. a tubular housing having an open end which is attached to the brush handle, a closed end with one or more vent openings therethrough, a side wall disposed between the open end and the closed end, said side wall having a guide area on a portion of its surface and an opening through the side wall positioned in the guide area in line with the outlet opening of the brush head platform when the cover is in the closed position; and ii. a plug comprised of a slidable saddle flange having a sealing rod attached to its inner surface, said saddle flange being slidably mounted in the guide area of the side wall surface in a manner such that the sealing rod is engaged through the opening in the side wall and is aligned and mateable with the opening in the platform of the brush head.

8. A dentifrice dispensing toothbrush comprising:

a. a pump assembly which consists of:

i. a pump chamber having a base which has an interior surface and an exterior surface, a top, a side wall disposed between the interior surface of the base and the top, a first opening positioned in the base, an annular rim positioned on the exterior surface of the base in close proximity to the opening in the base, a second opening positioned in either the sidewall or the top and a third opening positioned in the top;

ii. a resilient, elastic, compressible button for supplying a pumping force, said button having an external surface, an internal surface and a base which is fixed to the second opening in the top or side wall of the pump chamber in a manner such that the button is depressed when a pumping force is applied to its external surface forcing dentifrice material to flow from the pump chamber through the third opening in the top thereof, and is returned to its original shape by its resilient force when the pumping force is released causing dentifrice material to flow to the pump chamber through the first opening in the base of the chamber;

iii. a flap check valve attached to the interior surface of the base for preventing backflow of dentifrice material through the first opening in the base of the pump chamber;

b. a brush head having a platform with an outlet opening therethrough and a series of bristles which are attached to the platform;

c. a neck comprising a hollow conduit having two open ends, one of which is in communication with the opening in the platform of the brush head and the remaining of which is in communication with the third opening in the top of the pump chamber;

d. a brush handle comprising a housing for storing a removable cartridge, said housing being comprised of a tubular side wall having a top which is attached to the exterior surface of the base of the pump chamber and a bottom which is open; and e. a removable cartridge stored in said housing, said removable cartridge being comprised of:

i. a top which has an interior surface, an exterior surface, an opening therethrough which is in communication with the opening in the base of the pump chamber and an annular groove positioned on its exterior surface in close proximity to the opening in the top, said groove being mateable with the rim on the exterior surface of the base of the pump chamber when the removable cartridge is stored in the housing;

ii. a base;

iii. a side wall disposed between the base and the top; and iv. a follower disc.

* * * * *